US011035234B2

(12) United States Patent
Naik et al.

(10) Patent No.: US 11,035,234 B2
(45) Date of Patent: Jun. 15, 2021

(54) AIRFOIL HAVING A TIP CAPACITY

(71) Applicant: ANSALDO ENERGIA SWITZERLAND AG, Baden (CH)

(72) Inventors: Shailendra Naik, Gebenstorf (CH); Christian Sommer, Nussbaumen (CH)

(73) Assignee: ANSALDO ENERGIA SWITZERLAND AG, Baden (CH)

( * ) Notice: Subject to any disclaimer, the term of this patent is extended or adjusted under 35 U.S.C. 154(b) by 287 days.

(21) Appl. No.: 15/471,683

(22) Filed: Mar. 28, 2017

(65) Prior Publication Data

US 2017/0284207 A1 Oct. 5, 2017

(30) Foreign Application Priority Data

Mar. 29, 2016 (EP) ..... 16162708

(51) Int. Cl.
*F01D 5/18* (2006.01)
*F01D 5/20* (2006.01)

(52) U.S. Cl.
CPC ..... *F01D 5/186* (2013.01); *F01D 5/20* (2013.01); *F05D 2220/32* (2013.01); *F05D 2240/30* (2013.01); *F05D 2260/202* (2013.01)

(58) Field of Classification Search
CPC ..... F01D 5/12; F01D 5/14; F01D 5/18; F01D 5/186; F01D 5/20; F01D 11/00–24; F05D 2240/30; F05D 2240/304; F05D 2240/307; F05D 2260/202
See application file for complete search history.

(56) References Cited

U.S. PATENT DOCUMENTS 5,564,902 A 10/1996 Tomita
5,927,946 A * 7/1999 Lee ..... F01D 5/20 415/115
6,224,336 B1 * 5/2001 Kercher ..... F01D 5/186 415/115

(Continued)

FOREIGN PATENT DOCUMENTS

EP 0 684 364 A1 11/1995
EP 2 230 383 A1 9/2010

OTHER PUBLICATIONS

Extended European Search Report dated Sep. 6, 2016, by the European Patent Office in corresponding European Patent Application No. 16162708.8-1610. (8 pgs.).

(Continued)

*Primary Examiner* — Christopher Verdier
*Assistant Examiner* — Elton K Wong
(74) *Attorney, Agent, or Firm* — Buchanan Ingersoll & Rooney PC

(57) ABSTRACT

An airfoil for a working fluid path of a turboengine extends along a spanwidth direction from a base to a tip. An aerodynamic body thereof includes a suction side surface, a pressure side surface, a leading edge, a trailing edge and a tip, the tip of the aerodynamic body having a tip cross section and a cross-sectional contour circumscribing the tip cross section. A rim extends to the tip of the airfoil and follows the cross-sectional contour on the pressure side, the suction side and extends over the leading edge of the airfoil, the rim delimiting a tip cavity which is open at the tip of the airfoil. The rim is further open at the trailing edge of the airfoil such that the tip cavity is open at the trailing edge of the airfoil.

12 Claims, 3 Drawing Sheets

(56) References Cited

U.S. PATENT DOCUMENTS

| | | | | |
|---|---|---|---|---|
| 7,118,329 | B2 | 10/2006 | Goodman | |
| 2007/0237637 | A1* | 10/2007 | Lee | F01D 5/20 416/97 R |
| 2008/0118367 | A1* | 5/2008 | Liang | F01D 5/186 416/97 R |
| 2011/0176929 | A1* | 7/2011 | Ammann | F01D 5/186 416/97 R |
| 2012/0070308 | A1 | 3/2012 | Naik et al. | |
| 2014/0099193 | A1* | 4/2014 | Zhang | F01D 5/20 415/178 |
| 2015/0292334 | A1* | 10/2015 | Mongillo, Jr. | F01D 5/20 416/97 R |
| 2015/0292335 | A1* | 10/2015 | Dawson | F01D 5/145 416/97 R |
| 2016/0245095 | A1* | 8/2016 | Chouhan | F01D 5/20 |

OTHER PUBLICATIONS

First Office Action dated Sep. 30, 2020, by the Chinese Patent Office in corresponding Chinese Patent Application No. 201710197963.9, and an English Translation of the Office Action. (15 pages).

* cited by examiner

AIRFOIL HAVING A TIP CAPACITY

PRIORITY CLAIM

This application claims priority from European Patent Application No. 16162708.8 filed on Mar. 29, 2016, the disclosure of which is incorporated by reference.

TECHNICAL FIELD

The present disclosure relates to an airfoil for use in the working fluid path of a turboengine.

BACKGROUND OF THE DISCLOSURE

As is well-known to the person skilled in the art, turboengines comprise blades and vanes. Said blades and vanes comprise airfoils, said airfoils having a suction side, a pressure side, a leading edge and a trailing edge. The location of the suction side, the pressure side, the leading edge and the trailing edge will become immediately apparent to the skilled person at the sight of an airfoil. For instance, as a general rule of thumb at least for airfoils intended for subsonic applications, it can be stated that the airfoil is concavely shaped on the pressure side and is convexly shaped on the suction side. The leading edge and the trailing edge connect the pressure side and the suction side. For the provided instance of an airfoil for subsonic and transonic applications the leading edge exhibits a comparatively larger radius when compared to the trailing edge, while the trailing edge is shaped with a considerably smaller radius, or is even shaped as an actual sharp edge.

When fluid flows around the airfoil from the leading edge to the trailing edge the pressure on the pressure side is higher than on the suction side, which causes the required flow deflection in the instance of a stationary vane and in addition results in a driving force in the instance of a rotating blade, or, more generally speaking, the energy conversion in the turboengine. An unwanted effect at airfoils are flows from the pressure side to the suction side over the tip of an airfoil. Not only do those flows constitute mere leakage flows, but as will be appreciated reduce, in the tip region, the pressure on the pressure side, increase the pressure on the suction side, and thus compromise the effectiveness of the energy conversion. Moreover, pressure gradients along the spanwidth of the airfoil may result in further irregular flow patterns and thus induce additional losses.

While the use of shrouded blades may provide a remedy, the use of shrouded blades is frequently not feasible for various reasons. Numerous attempts to reduce the leakage flows over airfoil tips are known from the art, which focus on the reduction of gaps over the airfoil tip, and/or the provision of sealing arrangements, all with the goal to reduce the leakage mass flows. It goes without saying that only contactless sealing arrangements are feasible, and thus airfoil tip flows cannot be totally avoided with non-shrouded blades.

U.S. Pat. No. 7,118,329 and US 201510292335 disclose an airfoil for use in the working fluid path of a turboengine, the airfoil extending along a spanwidth direction from a base to a tip. The airfoil exhibits a suction side, a pressure side, a leading edge and a trailing edge. The airfoil comprises an airfoil aerodynamic body, the aerodynamic body comprising a suction side surface, a pressure side surface, a leading edge, a trailing edge and a tip, said tip of the aerodynamic body having a tip cross section and a cross-sectional contour circumscribing the tip cross section.

A rim is disposed at the tip of the aerodynamic body and extending from the tip of the aerodynamic body to the tip of the airfoil, and further following said cross-sectional contour on the pressure side, the suction side and extending over the leading edge of the airfoil. The rim extends just to the trailing edge. The rim delimits a tip cavity which is open at the tip of the airfoil, and the rim is further open at the trailing edge of the airfoil such that the tip cavity is open at the trailing edge of the airfoil. The tip cavity is thus in fluid communication with the fluid provided at the trailing edge of the airfoil, that is, a low pressure area. Consequently, fluid flowing from the pressure side and over, or towards, respectively, the airfoil tip gets thus sucked into the tip cavity and is discharged at the trailing edge. It is noted that the rim is a thin-walled structural member, which may, in particular when used in the expansion turbine of a gas turbine engine, be exposed to a high temperature fluid flow. Moreover, when used in an internal combustion gas turbine engine, the rim is exposed to a flue gas flow.

LINEOUT OF THE SUBJECT MATTER OF THE PRESENT DISCLOSURE

It is an object of the present disclosure to provide an improved airfoil of the kind cited above. In a more specific aspect it is an object to provide an airfoil which is designed to provide a reduced impact of tip leakage flows on the airfoil efficiency. In a still more specific aspect the airfoil shall be provided to reduce the impact of inadvertent tip leakage flows on the airfoil performance and efficiency.

This is achieved by the subject matter described in claim 1.

Further effects and advantages of the disclosed subject matter, whether explicitly mentioned or not, will become apparent in view of the disclosure provided below.

Accordingly, disclosed is an airfoil for use in the working fluid path of a turboengine, the airfoil extending along a spanwidth direction from a base to a tip. The base of the airfoil may generally be attached to a blade foot or may be provided with attachment means for attaching it to a blade foot member. The turboengine may in certain embodiments be a gas turbine engine, and in more particular embodiments a heavy duty gas turbine engine. The airfoil may be intended for use in an expansion turbine. The airfoil exhibits a suction side, a pressure side, a leading edge and a trailing edge. The airfoil comprises an airfoil aerodynamic body, the aerodynamic body comprising a suction side surface, a pressure side surface, a leading edge, a trailing edge and a tip, said tip of the aerodynamic body having a tip cross section and a cross-sectional contour circumscribing the tip cross section. It is noted in this respect that neither the airfoil nor the airfoil aerodynamic body need be a discrete member. The airfoil may be an integral part of a blading member. The airfoil aerodynamic body is an integral part of an airfoil member, or of an airfoil which in turn may be an integral part of a blading member. The airfoil aerodynamic body is to be understood as the section of an airfoil member or a section of a blading member which exhibits the aerodynamic shape, comprising a suction side surface, a pressure side surface, a leading edge and a trailing edge, which effects the buildup of the pressure difference between the pressure side and the suction side, along with the flow deviation and/or the associated force to drive a rotor. A blading member may in this respect be a blading member for a stationary vane row as well as a blading member for a rotating blade row. The airfoil may accordingly be an airfoil intended for use as a stationary airfoil for a vane as well as intended for use as a rotating airfoil for a rotating blade. The airfoil may for instance be twisted with a twist axis parallel to the spanwidth direction. The aerodynamic body may in certain embodiments comprise, as will be readily appreciated, any kind of internal coolant ducts and/or coolant discharge orifices opening out on the outer surface of the aerodynamic body the skilled person is familiar with. A rim is disposed at the tip of the aerodynamic body and extending from the tip of the aerodynamic body to the tip of the airfoil, and further following said cross-sectional contour on the pressure side, the suction side and extending over the leading edge of the airfoil. In particular, the rim may extend just to the trailing edge. The rim delimits a tip cavity which is open at the tip of the airfoil, and the rim is further open at the trailing edge of the airfoil such that the tip cavity is open at the trailing edge of the airfoil. The tip cavity is thus in fluid communication with the fluid provided at the trailing edge of the airfoil, that is, a low pressure area. Consequently, fluid flowing from the pressure side and over, or towards, respectively, the airfoil tip gets thus sucked into the tip cavity and is discharged at the trailing edge. Fluid from the pressure side thus is at least partially, if not completely, prevented to flow over the tip to the suction side. A loss of fluid on the pressure side may thus not be completely prevented, however said fluid cannot have an impact on the suction side or at least said impact is largely reduced. At least one fluid duct comprising a discharge orifice opens out onto the bottom of the tip cavity through said discharge orifice. Said duct may in particular be in fluid communication with an interior of the aerodynamic body and may for instance be provided as a coolant duct. The at least one fluid duct is provided, arranged and configured as a film cooling duct and may more in particular be arranged and configured to discharge a coolant with a velocity component directed from the leading edge to the trailing edge. It is understood that the discharge characteristics, in particular the coolant discharge trajectories, of the film coolant duct are determined by the shaping of the discharge orifice. It is to this extent presumed that the skilled person is familiar with the principles of film cooling and the rules to obey when providing film coolant discharge ducts and orifices. Said orientation of the discharged coolant, at least partially in line with the main flow direction in the tip cavity, helps to maintain a coolant film on the bottom of the tip cavity. In a more specific aspect, the at least one film cooling duct is provided such that the flow of coolant is directed to the inner surfaces of the rim which delimit the tip cavity. Thus, cooling of the rim is effected. Moreover, the discharged coolant, with a velocity component directed towards the open end of the tip cavity, supports providing a flow in the tip cavity which is discharged at the trailing edge.

In another aspect, at least two film cooling ducts are provided, wherein at least one film cooling duct is provided to direct a coolant flow towards a section of the rim provided on the suction side, and at least one film cooling duct is provided to direct a coolant flow towards a section of the rim provided on the pressure side of the airfoil.

It will furthermore be understood, and should be taken as self-evident, that an exterior surface of the rim is provided with a continuous, smooth and seamless transition to the outer surface of the aerodynamic body.

In certain embodiments the thickness of the rim, as measured from an outer surface, constituting an extension of the outer surface of the aerodynamic body, and an inner surface, delimiting the tip cavity, is smaller at the trailing edge than at the leading edge. This results in superior aerodynamic properties of the rim, with a separation edge being provided at the trailing edge of the airfoil.

In further instances, at least one first fluid duct is provided with a first discharge orifice located at a first distance from the rim and at least one second fluid duct is provided with a second discharge orifice being located at a larger distance from the rim than the first discharge orifice of the first fluid duct. In certain exemplary embodiments the discharge orifice of the at least one first fluid duct is located adjacent the rim, and may more specifically be located adjacent the rim on the suction side of the airfoil. The second fluid ducts may, just as the first fluid ducts, be provided to discharge a film coolant onto the bottom surface of the tip cavity, and be arranged to fulfil analogous conditions, that is, discharge a coolant flow with at least a velocity component directed in line with the main flow direction in the tip cavity.

According to still more specific embodiments, the first discharge orifice of the at least one first fluid duct is shaped by a cylindrical geometry and the second discharge orifice of the at least one second fluid duct is a fan-shaped orifice. It is understood that accordingly, with a tilted first fluid duct, the respective discharge orifice exhibits an elliptical geometry on the bottom of the tip cavity. It will be appreciated that the fan-shaped discharge orifices are well-suited to provide a low impulse coolant film over the surface of the bottom of the tip cavity, while the non-fan-shaped discharge orifices of the first fluid ducts may be provided to discharge the coolant with an enhanced velocity component along the rim for providing cooling of the rim from inside the rim cavity.

According to still a further aspect at least one further rim coolant duct may be provided with a discharge orifice provided on the outer contour of the aerodynamic body in the tip region of the aerodynamic body and adjacent the rim. Said at least one further rim coolant duct is provided with a geometry of the respective discharge orifice fostering a discharge of a coolant on the outer surface of the airfoil which comprises velocity components directed to the tip of the airfoil as well as to the trailing edge, or, more generally spoken, following the flow of fluid along the outer contour of the airfoil if the incident flow is provided as intended by the airfoil design. The at least one further rim coolant duct thus is provided to disperse the coolant over an outer surface of the rim. Thus, both lateral surfaces of the rim are cooled by film cooling. The rim is thus even more intensely cooled and overheating of the rim is even more reliably avoided. In more particular embodiments said further discharge orifices may be fan-shaped. Said at least further rim coolant duct may in certain embodiments be provided with the respective discharge orifice located on the pressure side of the airfoil and/or in a leading edge region. The coolant, or, more generally spoken fluid discharged from the at least one further rim coolant duct, may further serve to provide an additional aerodynamic barrier layer against working fluid flowing from the pressure side of the airfoil over the rim and to the tip region of the airfoil. Additionally, at least one further rim coolant duct may be provided on the outer contour of the aerodynamic body in the tip region of the aerodynamic body and adjacent the rim in the region of the leading edge. Thus, in the regions of the airfoil where comparatively high pressure is present, cooling of the rim is effected by coolant provided on the outer circumferential area of the rim, thus at the same time providing additional shielding against leakage flows, while on the low pressure side the cooling may be provided from within the tip cavity through the at least one first fluid duct.

As indicated above, the at least one first fluid duct, or a multitude of first fluid ducts, may in certain embodiments be provided with the respective discharge orifice located inside the tip cavity and adjacent the suction sided rim section, thus effecting cooling of the rim on the suction side. At least one further rim coolant duct, or a multitude of further rim coolant ducts, may, in more specific embodiments, be provided with the respective discharge orifice located on the pressure side and/or the leading edge region of the airfoil in the tip region. Reference is made to the discharge trajectories cited above. Thus cooling of the rim on the pressure side is effected while at the same time providing additional aerodynamic shielding against working fluid leakage.

In certain embodiments, at least in a trailing edge region of the airfoil, two sections of the rim which are disposed, or arranged, respectively, on opposite sides of the camber line of the airfoil diverge from the tip of the aerodynamic body to the tip of the airfoil, such that a view on the airfoil from the trailing edge resembles a tulip-shaped, cup-shaped, or, in connection with the trailing edge, a substantially Y-shaped, geometry. This serves on the one hand to provide an enhanced discharge cross section of the tip cavity at the narrow trailing edge. On the other hand this geometry may also serve to provide a further obstacle to leakage flows as it requires an augmented flow deflection for any fluid passing between any of the pressure and suction side and the tip region of the airfoil.

However it may be provided that the rim, at least in a leading edge region, extends at least essentially parallel to the spanwidth direction of the airfoil from the tip of the aerodynamic body to the tip of the airfoil. This may further serve to enhance the overall aerodynamic properties of the airfoil.

It may further be provided that a bottom of the tip cavity is provided by a tip surface of the aerodynamic body. That is, in other words, the aerodynamic body comprises a tip surface delimiting the aerodynamic body at the tip, or towards the tip of the airfoil. As the rim, said rim delimiting the tip cavity, extends from the tip of the aerodynamic body to the tip of the airfoil and along the cross sectional contour of the aerodynamic body, it is particularly appropriate to provide the tip surface of the aerodynamic body as a bottom of the rim, i.e. to provide a delimitation of the tip cavity towards the base of the airfoil.

A distance from the airfoil tip to the bottom of the tip cavity constitutes a depth of the tip cavity. In certain embodiments it may be provided that the depth of the tip cavity, measured from the tip of the airfoil to the bottom of the cavity, is smaller at the trailing edge than at the leading edge. In certain more specific embodiments the depth of the tip cavity decreases continuously from the leading edge to the trailing edge.

In a further aspect of the disclosed subject matter the tip cavity may be provided such that a cross sectional area of the tip cavity, taken perpendicular to the camber line of the airfoil, narrows from a position between the leading edge and the trailing edge and along an extent towards the trailing edge, or the discharge opening of the tip cavity, respectively. More particularly, the tip cavity may be provided such that a trailing edge cross sectional area of the tip cavity taken at the trailing edge and perpendicular to the camber line is 60% or less than a center cross sectional area of the tip cavity taken at 50% of the airfoil chord length, or camber line extent, respectively, and perpendicular to the camber line. This may in particular be achieved in contouring the rim or the bottom of the tip cavity, or both in combination, accordingly. In shaping the cross sections of the tip cavity accordingly, the velocity of a fluid flow therein and discharged at the trailing edge, and in turn the static pressure in the rim cavity may be controlled. This allows for a control of the suction intensity for fluid ingested into the tip cavity, which, according to certain aspects, may be adjusted such that on the one hand at least essentially all tip leakage flow from the pressure side of the airfoil and in a gap provided adjacent the tip of the airfoil is drained into the tip cavity, while it is avoided to overly enhance the loss of fluid from the pressure side.

Further disclosed is a blading member for a turboengine, the blading member comprising a foot and at least one airfoil, the airfoil extending along a spanwidth direction from a base to a tip, the base being connected to the foot of the blading member, wherein the airfoil is an airfoil as described above. It is understood that the foot comprises attachment features for attaching the blading member to a stator or a rotor of a turboengine. A blading member may comprise a single airfoil attached to a foot or may comprise a multitude of airfoils attached to a common foot. The at least one airfoil and the foot may be provided integral with each other, but may in other instances be provided as separate members, and the blading member may accordingly be a blading member assembled from at least one airfoil member and a foot member.

Further disclosed is a turboengine comprising at least one blading member and/or airfoil as disclosed above. The turboengine may in particular be a gas turbine engine, and the blading member and/or the airfoil may more in particular be provided in the expansion turbine of the gas turbine engine.

It is understood that the specification of "at least one" element or member in the context as used above discloses the presence of a single element or member as well as the presence of a multitude of elements or members.

It is understood that the features and embodiments disclosed above may be combined with each other. It will further be appreciated that further embodiments are conceivable within the scope of the present disclosure and the claimed subject matter which are obvious and apparent to the skilled person.

BRIEF DESCRIPTION OF THE DRAWINGS

The subject matter of the present disclosure is now to be explained in more detail by means of selected exemplary embodiments shown in the accompanying drawings. The figures show FIG. 1 a first view of the tip region of an airfoil according to the present disclosure.

It is understood that the drawings are highly schematic, and details not required for instruction purposes may have been omitted for the ease of understanding and depiction. It is further understood that the drawings show only selected, illustrative embodiments, and embodiments not shown may still be well within the scope of the herein disclosed and/or claimed subject matter.

EXEMPLARY MODES OF CARRYING OUT THE TEACHING OF THE PRESENT DISCLOSURE

Figure 1:
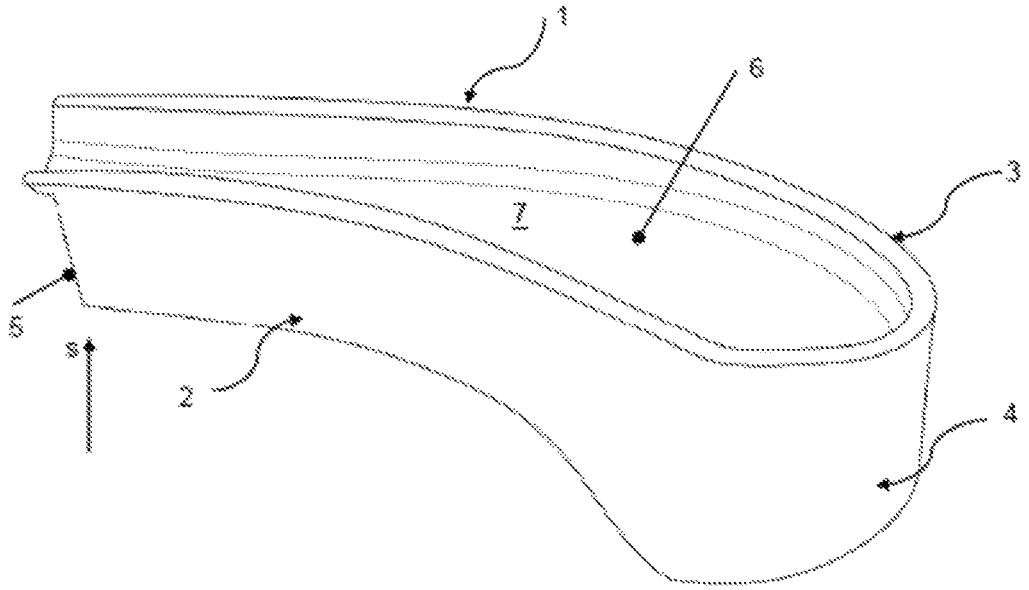

FIG. 1 depicts the tip region of an airfoil according to the above description. The airfoil 1 extends along a spanwidth direction, which is denoted by arrow s, from a base to a tip, whereas the base of the airfoil is not shown in the current depiction. Airfoil 1 generally comprises aerodynamic body 2 and further comprises leading edge 4, trailing edge 5, a concavely shaped pressure side and a convexly shaped suction side. The pressure side and the suction side are not denoted by reference numerals, but their location in the drawing will become readily apparent to the skilled person. It can generally be said that FIG. 1 provides a view from the leading edge, the pressure side and the tip of the airfoil. The aerodynamic body 2 comprises a tip which is defined by a tip surface 6. In a view from the tip and parallel to the orientation of the spanwidth direction, aerodynamic body 2 exhibits a cross sectional contour circumscribing the tip of the aerodynamic body. Said cross sectional contour comprises, as becomes readily apparent, a pressure side contour line, a suction side contour line, a leading edge point and a trailing edge contour. A rim 3 extends from the tip of the aerodynamic body to the tip of the airfoil and along said cross-sectional contour at the tip of the aerodynamic body. An exterior surface of the rim is provided with a continuous, smooth and seamless transition to the outer surface of the aerodynamic body. The rim is open at the trailing edge of the airfoil. The rim thus delimits a tip cavity 7 which is open towards the tip of the airfoil and at the trailing edge, and which is further delimited by the tip surface 6 of the aerodynamic body, which thus at the same time defines a bottom of the tip cavity 7. As will be appreciated, when used as intended in a turboengine, the tip of the airfoil is placed opposite a counterpart element. Due to the fact that the counterpart element and the tip of the airfoil perform relative movement during operation of a turboengine, a gap is provided between the tip of the airfoil and the counterpart element. It can be stated that tip cavity 7 provides a duct which is open at the trailing edge. During operation of a turboengine in which the airfoil 1 is used a certain tip leakage flow will inadvertently be present from the pressure side of the airfoil and through the gap formed between the tip of the airfoil and the above-mentioned counterpart element. As tip cavity 7 is in fluid communication with the exterior of the airfoil at the trailing edge, said leakage flow is at least partially sucked into tip cavity 7 and discharged at the trailing edge. The leakage flow from the pressure side may thus not, or only a fraction thereof, reach the suction side and induce pressure gradients on the suction side, which are potentially associated with secondary flows.

Figure 2:
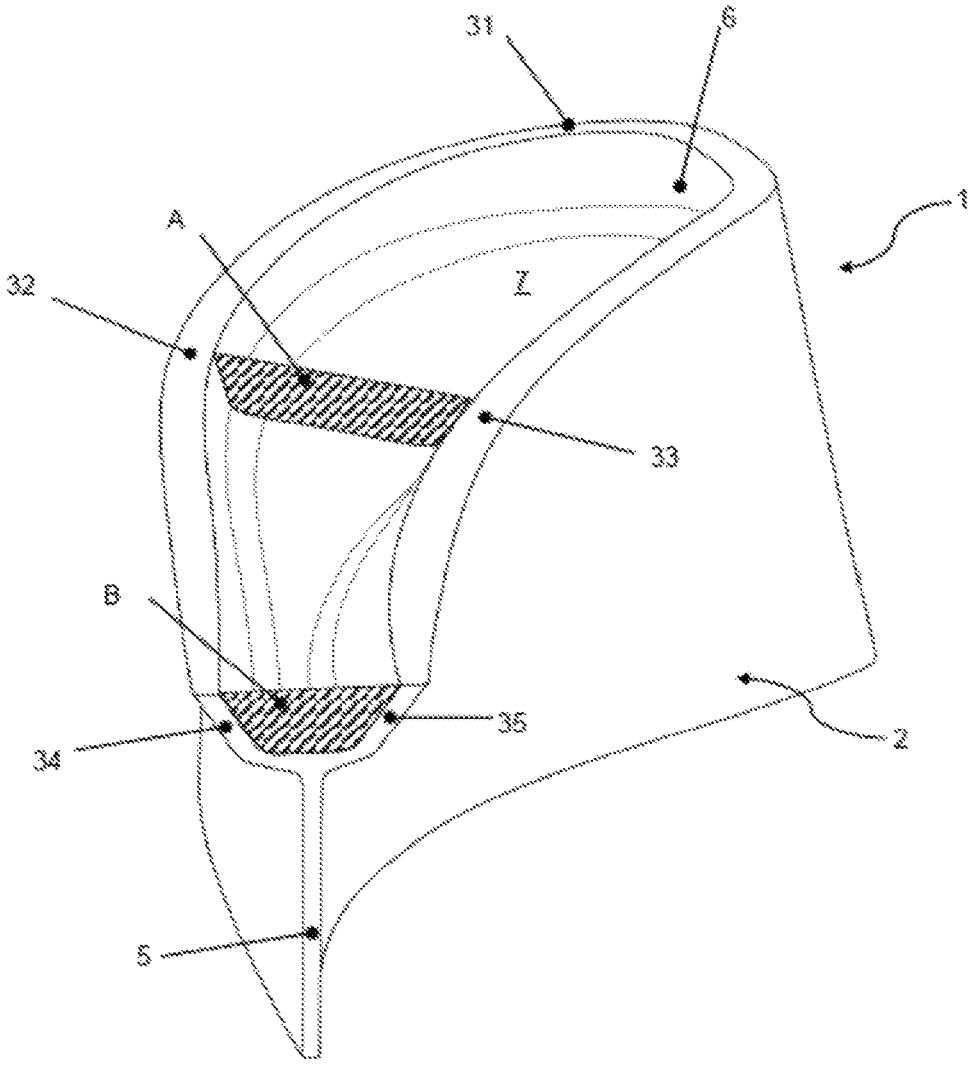
FIG. 2 a second view of the tip region of an airfoil according to the present disclosure.

With reference to FIG. 2 a view on the tip region of airfoil 1 from the tip, the suction side and the trailing edge 5 is provided. Trailing edge regions 34 and 35 of the rim are provided on the suction side and the pressure side of the airfoil, respectively, and diverge in a direction from the tip of the aerodynamic body to the tip of the airfoil. A leading edge section 31 of the rim extends at least essentially parallel to the spanwidth direction. Due to the mutual divergence of the trailing edge rim sections 34 and 35 a view on the airfoil tip region from the trailing edge resembles a general Y-, tulip- or cup-shape. A width of the rim as measured from an outer surface, constituting an extension of the outer surface of the aerodynamic body, and an inner surface, delimiting the tip cavity, is smaller in the trailing edge sections 34 and 35, respectively, than in the leading edge section 31, the suction side section 32 and the pressure side section 33. As becomes apparent, tip cavity 7 may be considered as a duct extending essentially along the camber line of the airfoil and being in fluid communication with the exterior of the airfoil at the trailing edge. A discharge cross section B, taken perpendicular to the camber line and at the trailing edge, is smaller than a cross section A taken perpendicular to the camber line and at approximately 50% of the airfoil chord length. For instance, the cross-sectional area in B is 60 percent or less than the cross-sectional area in A. Thus, a fluid flow through tip cavity 7 in a direction from the leading edge to the trailing edge gets accelerated towards the trailing edge. Consequently, the static pressure in tip cavity 7, if fluid is discharged from tip cavity 7 at the trailing edge, is higher in the leading edge region than at the trailing edge. Said variation of the cross section may on the one hand be accomplished in that the rim at least approximately follows the general contour of the airfoil aerodynamic body, thus narrowing the extent of tip cavity 7 from a location of maximum profile thickness to the trailing edge. It may furthermore be accomplished in that a depth of the tip cavity, measured from the tip of the airfoil to the bottom 6 of the tip cavity 7, is smaller at the trailing edge than in other regions of the tip cavity.

Figure 3:
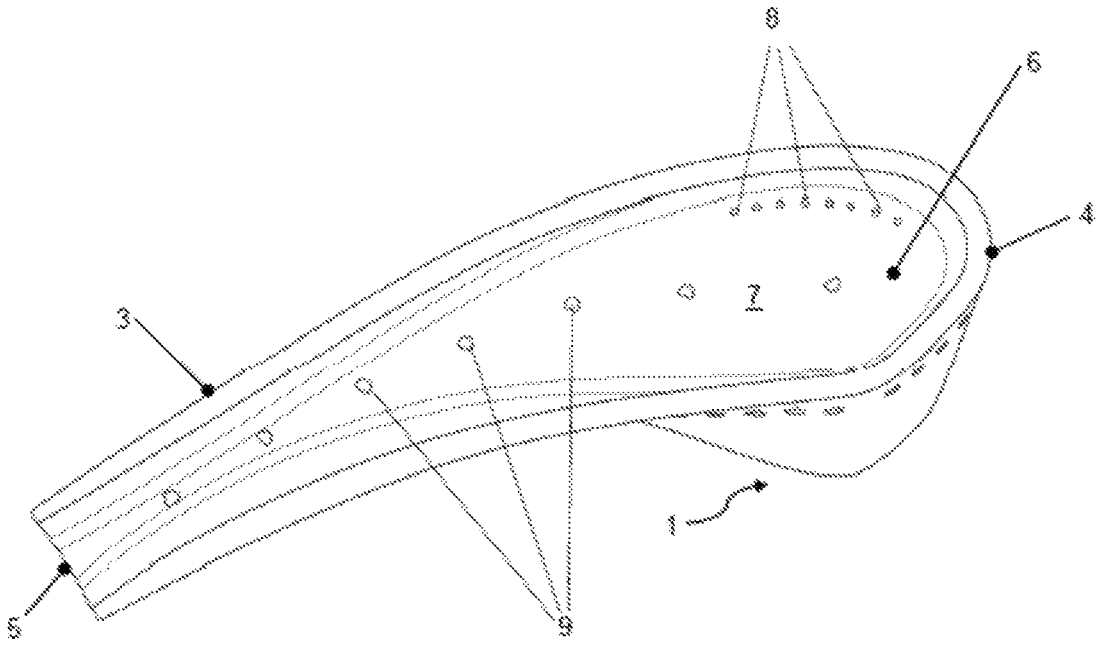
FIG. 3 a top view of the tip of an airfoil according to the present disclosure outlining details of an exemplary cooling arrangement.
Figure 4:
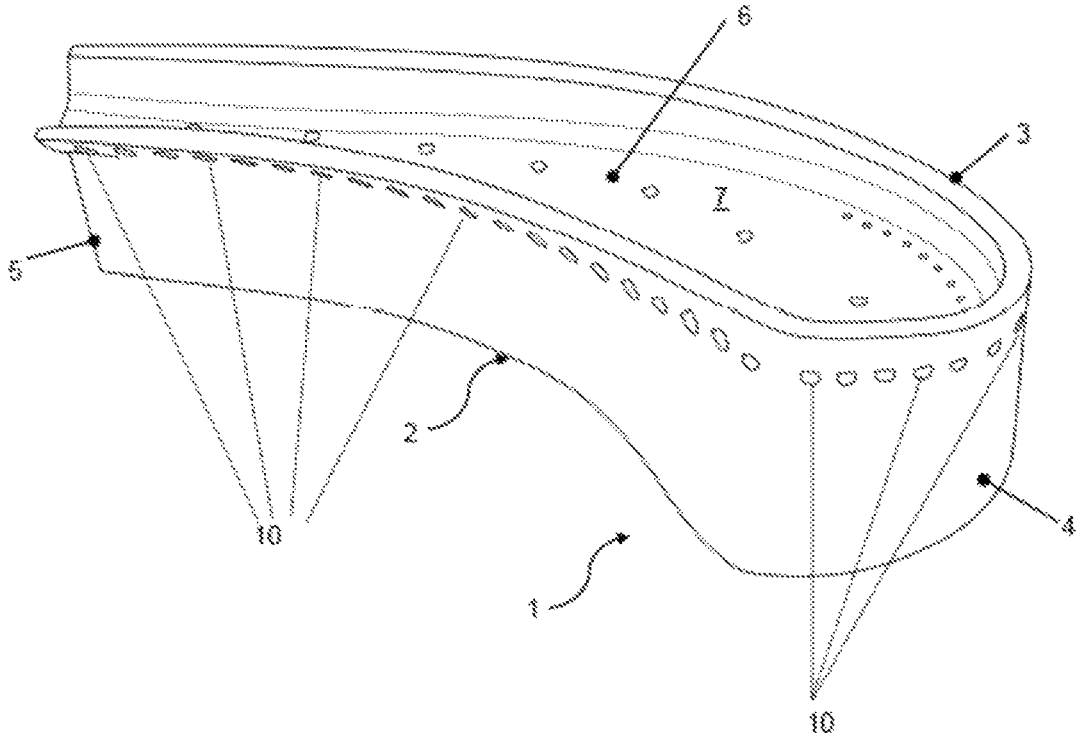
FIG. 4 a further view lining out further details of the exemplary cooling arrangement.

With reference to FIGS. 3 and 4 an exemplary arrangement of film cooling holes for cooling the rim is illustrated. FIG. 3 shows a view onto the tip of airfoil 1. First fluid ducts comprising first discharge orifices 8 are provided in the bottom 6 of tip cavity 7 adjacent rim 3 on the suction side. The first fluid ducts are in fluid communication with the interior of the aerodynamic body, which comprises an internal cooling configuration of the kind the skilled person is generally familiar with. The first fluid ducts are in the present instance generally cylindrical fluid ducts and terminate on the bottom 6 as cylindrical ducts. The fluid ducts are provided slanted with respect to the surface of bottom 6 of tip cavity 7 such as to discharge coolant at bottom 6 of tip cavity 7 with a velocity component parallel to the bottom of the tip cavity. First discharge orifices 8 thus appear elliptical on the bottom 6 of tip cavity 7. Coolant discharged from first discharge orifices 8 serves to cool the bottom 6 of the tip cavity, as well as the rim on the suction side. Further, second fluid ducts comprising fan-shaped second discharge orifices 9 are provided on bottom 6. Second fluid ducts are in fluid communication with the interior of the aerodynamic body. The second fluid ducts may be cylindrical, but may also exhibit other appropriate geometries. The fan-shaped second discharge orifices 9 and second fluid ducts are provided such as to provide the discharge flow with a velocity component oriented downstream the main flow direction of the fluid in tip cavity 7, which is, as mentioned, directed towards the trailing edge, and at least essentially following the camber line. The skilled person will readily appreciate by virtue of the depiction that coolant discharged from discharge orifices 8, 9 will also be dispersed over an inner surface of the rim and effect cooling of the rim 3. The discharge flow from second discharge orifices 9 is in some of the shown instances also oriented comprising an additional velocity component. The second discharge orifices which are located closer to the trailing edge 5 in this instance discharge the discharge flow also with a velocity component directed towards the pressure side of the airfoil. It is understood that the second fluid ducts which open out onto the bottom 6 of the tip cavity may also be appropriately slanted with respect to the surface of the bottom to support the envisaged discharge direction, in a manner well-known to the skilled person.

FIG. 4 depicts further rim cooling orifices 10 provided on the exterior of the airfoil and being shaped such as to discharge a fluid flow with discharge trajectories having components oriented both following the streamlines of a fluid flow around the airfoil upon intended use of the airfoil in a turboengine, and towards the tip of the airfoil. Further rim cooling orifices 10 are provided on the pressure side of the airfoil and in a leading edge region. The further rim cooling orifices are discharge orifices of further rim coolant ducts provided adjacent to rim 3, which are, in a manner familiar to the skilled person, in fluid communication with coolant ducts provided inside the aerodynamic body. Further rim cooling orifices and the related coolant ducts are provided such as to provide film cooling of the rim 3 in the leading edge region and on the pressure side.

With respect to the above, it is presumed that the skilled person is perfectly familiar with the principles of film cooling and the rules to obey when providing fluid ducts and discharge orifices intended for film cooling purposes.

While the subject matter of the disclosure has been explained by means of exemplary embodiments, it is understood that these are in no way intended to limit the scope of the claimed invention. It will be appreciated that the claims cover embodiments not explicitly shown or disclosed herein, and embodiments deviating from those disclosed in the exemplary modes of carrying out the teaching of the present disclosure will still be covered by the claims.

LIST OF REFERENCE NUMERALS

1 airfoil
2 aerodynamic body of the airfoil
3 rim
4 leading edge
5 trailing edge
6 tip surface of aerodynamic body; bottom of tip cavity
7 tip cavity
8 first discharge orifice
9 second discharge orifice
10 further rim cooling orifice
31 leading edge section of rim
32 suction side section of rim
33 pressure side section of rim
34 trailing edge section of rim, disposed on suction side
35 trailing edge section of rim, disposed on pressure side
A center cross section of tip cavity taken perpendicular to camber line
B trailing edge cross section of tip cavity taken perpendicular to camber line
S spanwidth direction

The invention claimed is:

1. An airfoil configured for a working fluid path of a turboengine, the airfoil extending along a spanwidth direction from a base to a tip, the airfoil comprising:

an airfoil aerodynamic body, the aerodynamic body having a suction side surface, a pressure side surface, a leading edge, a trailing edge and a tip, said tip of the aerodynamic body having a tip cross section and a cross-sectional contour circumscribing the tip cross section;

a rim disposed at the tip of the aerodynamic body and extending to the tip of the airfoil and following said cross-sectional contour on a pressure side, a suction side, and extending over the leading edge of the airfoil, the rim delimiting a tip cavity which is open at the tip of the airfoil, wherein the rim is open at the trailing edge of the airfoil such that the tip cavity is open at the trailing edge of the airfoil; and a plurality of first fluid ducts having respective first discharge orifices which open out onto a bottom of the tip cavity through said first discharge orifices, the plurality of first fluid ducts being arranged and configured as film cooling ducts, the first discharge orifices being provided adjacent the rim on the suction side along the cross-sectional contour of the tip of the aerodynamic body, whereby the rim on the suction side is cooled by the first fluid ducts, a plurality of second fluid ducts having respective fan-shaped second discharge orifices which open out onto the bottom of the tip cavity through said second discharge orifices, the plurality of second fluid ducts being arranged and configured as film cooling ducts, the second discharge orifices being arranged to provide a discharge flow with a velocity component oriented downstream a main flow direction in the tip cavity, wherein at least some of the second discharge orifices discharge the discharge flow with an additional velocity component directed towards the pressure side of the airfoil, wherein the first discharge orifices are arranged between the second discharge orifices and the rim and between the camber line and the cross-sectional contour of the tip of the aerodynamic body, and each of the first discharge orifices is nearer to the leading edge than to the trailing edge;

wherein a depth of the tip cavity, measured from the tip of the airfoil to the bottom of the cavity, is smaller at the trailing edge than at the leading edge, and the depth of the tip cavity decreases continuously from the leading edge to the trailing edge.

2. The airfoil according to claim 1, wherein the second fluid ducts are arranged and configured to discharge a coolant with a velocity component directed from the leading edge to the trailing edge.

3. The airfoil according to claim 1, wherein the first discharge orifices direct a coolant flow towards a section of the rim provided on the suction side of the airfoil, and the second discharge orifices direct a coolant flow towards a section of the rim provided on the pressure side of the airfoil.

4. The airfoil according to claim 1, wherein at least one fluid duct is in fluid communication with an interior of the aerodynamic body.

5. The airfoil according to claim 1, wherein the at least one of the first discharge orifices is located at a first distance from the rim; and at least one of the second discharge orifices is located at a larger distance from the rim than the first distance.

6. The airfoil according to claim 1, wherein the first discharge orifices of the first fluid ducts are shaped by a cylindrical geometry.

7. The airfoil according to claim 1, comprising:

at least one further rim coolant duct having a discharge orifice provided on an outer contour of the aerodynamic body in the tip region of the aerodynamic body and adjacent the rim, wherein said at least one further rim coolant duct is provided with a geometry of the respective discharge orifice being shaped and arranged such as to discharge a coolant on the outer surface of the airfoil which includes velocity components directed to the tip of the airfoil as well as to the trailing edge, and to disperse the coolant over an outer surface of the rim.

8. The airfoil according to claim 1, comprising:

at least in a trailing edge region of the airfoil, two sections of the rim disposed on opposite sides of an airfoil camber line, which diverge from the tip of the aerodynamic body to the tip of the airfoil, such that a view on the airfoil from the trailing edge resembles a tulip-shaped geometry.

9. The airfoil according to claim 1, wherein the rim, in a leading edge region, extends at least essentially parallel to the spanwidth direction of the airfoil from the tip of the aerodynamic body to the tip of the airfoil.

10. The airfoil according to claim 1, wherein a trailing edge cross sectional area of the tip cavity taken at the trailing edge and perpendicular to a camber line is 60% or less than a center cross sectional area of the tip cavity taken at 50% of an airfoil chord length and perpendicular to the camber line.

11. A blading member for a turboengine, the blading member comprising:

a foot; and at least one airfoil, the airfoil extending along a spanwidth direction from a base to a tip, the base being connected to the foot of the blading member, wherein the airfoil includes:

an airfoil aerodynamic body, the aerodynamic body having a suction side surface, a pressure side surface, a leading edge, a trailing edge and a tip, said tip of the aerodynamic body having a tip cross section and a cross-sectional contour circumscribing the tip cross section;

a rim disposed at the tip of the aerodynamic body and extending to the tip of the airfoil and following said cross-sectional contour on a pressure side, a suction side, and extending over the leading edge of the airfoil, the rim delimiting a tip cavity which is open at the tip of the airfoil, wherein the rim is open at the trailing edge of the airfoil such that the tip cavity is open at the trailing edge of the airfoil; and a plurality of first fluid ducts having respective first discharge orifices which open out onto a bottom of the tip cavity through said first discharge orifices, the plurality of first fluid ducts being arranged and configured as film cooling ducts, the first discharge orifices being provided adjacent the rim on the suction side along the cross-sectional contour of the tip of the aerodynamic body, whereby the rim on the suction side is cooled by the first fluid ducts, a plurality of second fluid ducts having respective fan-shaped second discharge orifices which open out onto the bottom of the tip cavity through said second discharge orifices, the plurality of second fluid ducts being arranged and configured as film cooling ducts, the second discharge orifices being arranged to provide a discharge flow with a velocity component oriented downstream a main flow direction in the tip cavity, wherein at least some of the second discharge orifices discharge the discharge flow with an additional velocity component directed towards the pressure side of the airfoil, wherein the first discharge orifices are arranged between the second discharge orifices and the rim and between the camber line and the cross-sectional contour of the tip of the aerodynamic body, and each of the first discharge orifices is nearer to the leading edge than to the trailing edge;

wherein a depth of the tip cavity, measured from the tip of the airfoil to the bottom of the cavity, is smaller at the trailing edge than at the leading edge, and the depth of the tip cavity decreases continuously from the leading edge to the trailing edge.

12. The blading member of claim 11, in combination with a turboengine, the turboengine comprising:

a working fluid path, the airfoil being arranged therein.

* * * * *